United States Patent [19]

Coulombe

[11] 4,126,098

[45] Nov. 21, 1978

[54] BUTTONHOLE CAM UNIT WITH BALL BEARING CLUTCH

[75] Inventor: Lionel J. Coulombe, Matawan, N.J.

[73] Assignee: The Singer Company, New York, N.Y.

[21] Appl. No.: 859,429

[22] Filed: Dec. 12, 1977

[51] Int. Cl.[2] ..... D05B 3/06; F16D 11/04

[52] U.S. Cl. ..... 112/158 B; 192/24

[58] Field of Search ..... 112/158 B, 158 A, 158 R; 192/22, 24, 27

[56] References Cited

U.S. PATENT DOCUMENTS

| | | | |
|---|---|---|---|
| 503,311 | 8/1893 | Dahl | 192/27 |
| 2,299,621 | 10/1942 | Giffen et al. | 192/24 |
| 2,506,750 | 5/1950 | Surprenant | 192/27 X |
| 2,983,240 | 5/1961 | Engel | 112/158 B |
| 3,244,263 | 4/1966 | Fleming | 192/24 X |
| 3,585,876 | 6/1971 | Marsh | 112/158 B X |
| 3,795,208 | 3/1974 | Tolle | 112/158 B |
| 3,841,246 | 10/1974 | Casner et al. | 112/158 B X |

*Primary Examiner*—Werner H. Schroeder
*Assistant Examiner*—Andrew M. Falik
*Attorney, Agent, or Firm*—Robert E. Smith; Edward L. Bell; Edward W. Goodman

[57] ABSTRACT

A zig-zag sewing machine is disclosed which can be controlled by various special cam units for producing special patterns of zig-zag stitches, zig-zag stitch patterns combined with patterned work feed control, or closed stitch groups such as buttonholes. A cam unit for buttonholing is also disclosed in which a clutch is used for selective engagement of the cam unit. This clutch uses axially shiftable ball bearings for selectively engaging notches in a driving plate, coupling the driving plate to the rest of the buttonhole cam unit.

6 Claims, 9 Drawing Figures

Fig. 2
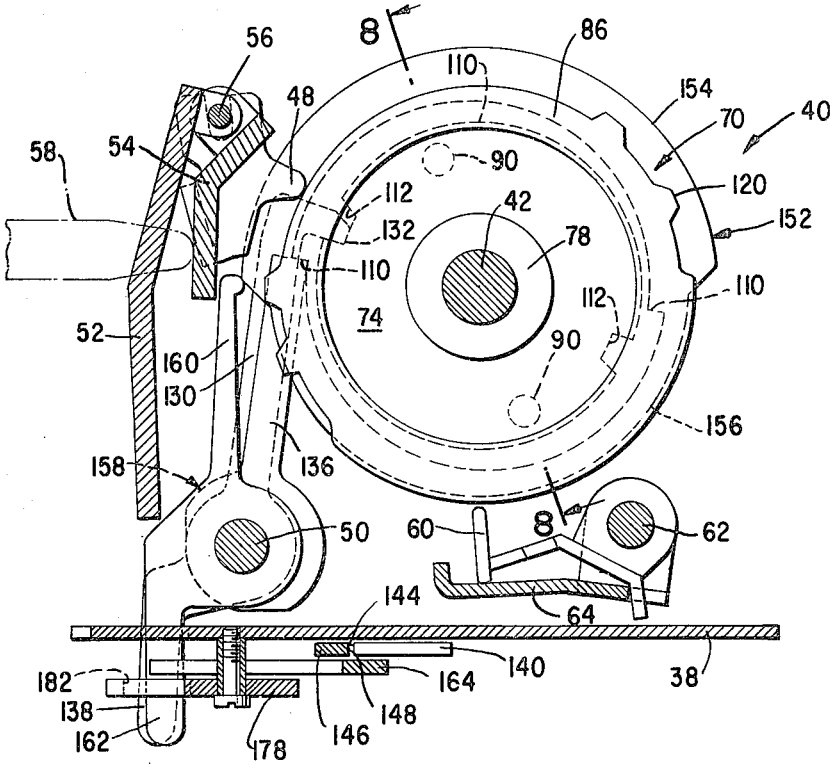
Fig. 5
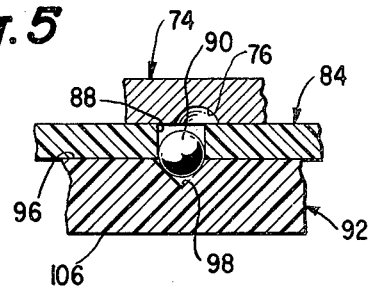
Fig. 7
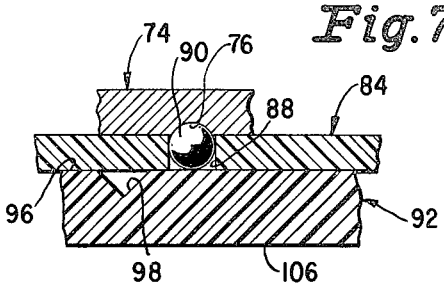
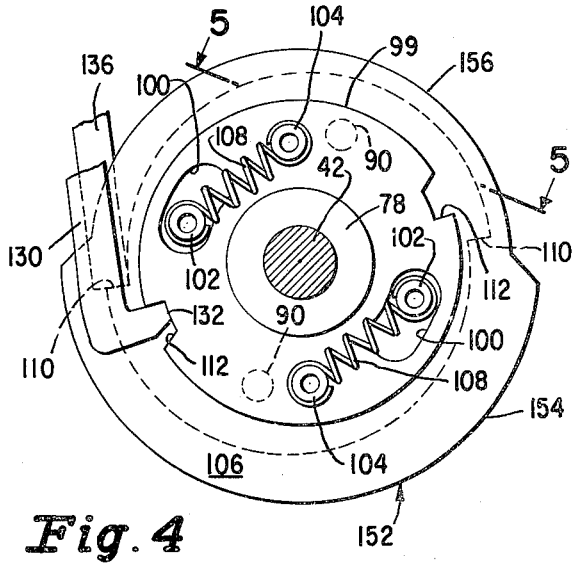
Fig. 4
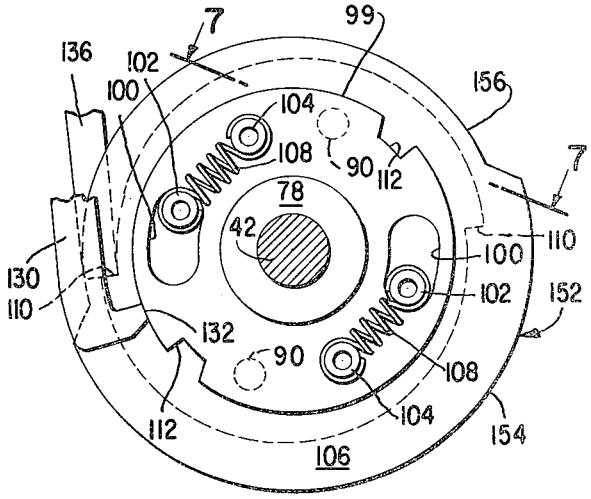
Fig. 6

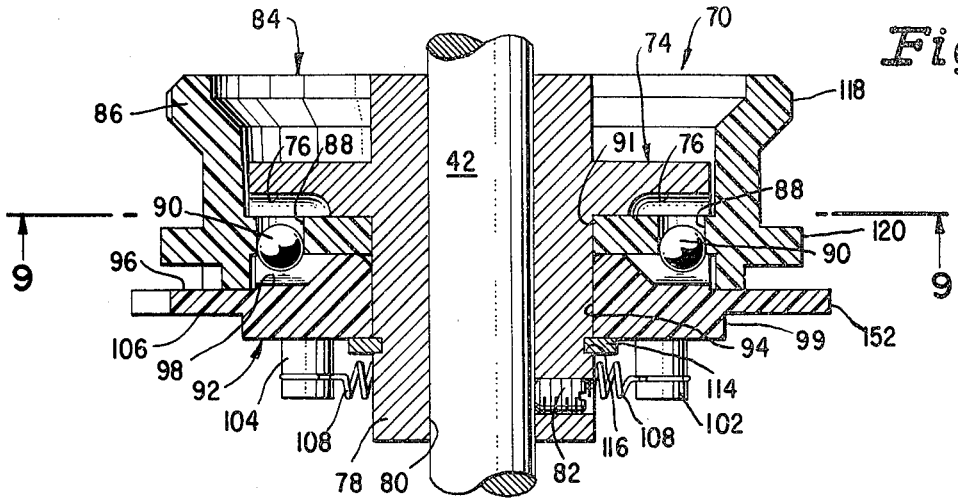
Fig. 8
Fig. 9
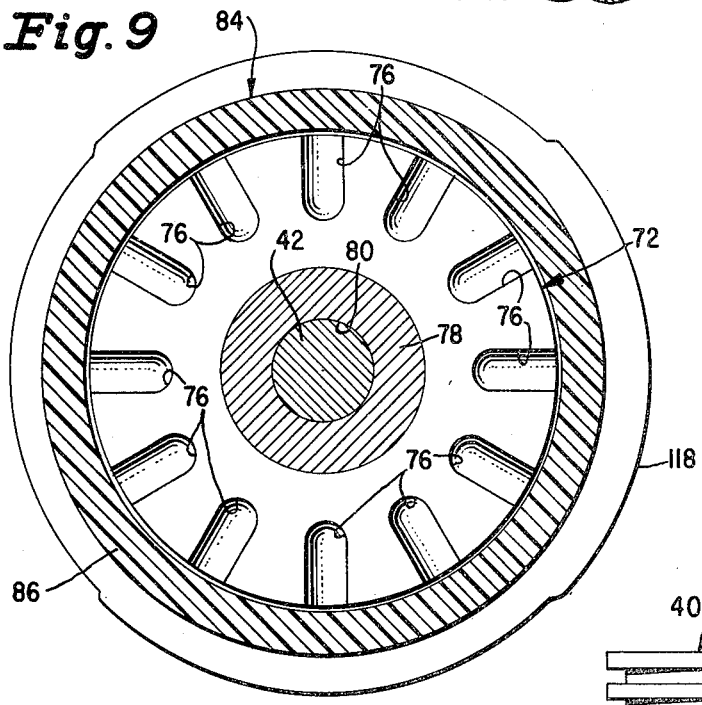
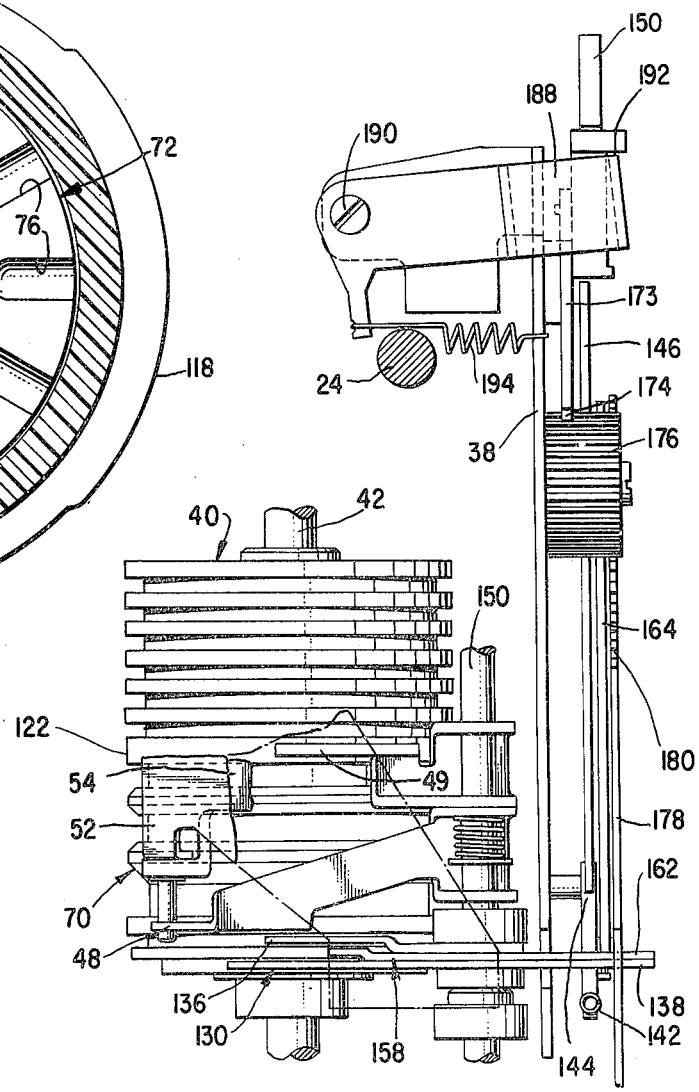
Fig. 3

BUTTONHOLE CAM UNIT WITH BALL BEARING CLUTCH

BACKGROUND OF THE DISCLOSURE

This invention relates to zig-zag sewing machines in which control of the lateral jogging movements of a needle, of the neutral position of needle vibration, and the direction and magnitude of work feed may be accomplished by pattern cam means. It is known in the prior art to apply a clutch to one or a group of cams in a pattern cam controlled sewing machine. U.S. Pat. No. 2,983,240, May 9, 1961, by W. Engel, discloses a sewing machine in which a cam unit for influencing the needle position and the work feed control may be intermittently driven so as to provide for the sewing of closed stitch groups such as buttonholes. The buttonhole cam unit of the Engel patent is shifted lengthwise of the cam shaft when it is clutched to or disengaged therefrom. U.S. Pat. No. 3,585,876, June 22, 1971, by Marsh et al, eliminates the need for axially shifting the buttonhole unit of the Engel device for clutching the same. However, the Marsh device requires a traveling pawl arrangement which is extremely critical to make.

SUMMARY OF THE INVENTION

The object of this invention is to provide a clutch for a buttonhole cam unit in a zig-zag sewing machine which is simple and relatively easy to manufacture and which does not require axially shifting of the cam unit itself to activate the clutch. This object is achieved through the use of a clutch having axially shiftable ball bearings, carried within a carrier plate for selective driving engagement with a driving plate fixedly attached to the cam shaft of the sewing machine. An engaging plate is provided for selectively cradling said ball bearings and for urging the ball bearings through the carrier plate into driving engagement with the driving plate.

DESCRIPTION OF THE DRAWINGS

With the above and additional objects and advantages in view as will hereinafter appear, this invention will be described with reference to the following drawings in which:

FIG. 2 is a cross-sectional view taken substantially along the line 2—2 in FIG. 1 showing the various cam followers for the buttonhole cam unit;

FIG. 3 is a cross-sectional view taken along the line 3—3 in FIG. 1 showing the clutch disengaging control pawls in the effective position and the various cams and cam followers along with the control and indicator linkage for the buttonhole cam unit;

FIG. 4 is a plan view of the bottom of the buttonhole cam unit with the clutch disengaged;

FIG. 5 is a cross-sectional view of portions of the buttonhole cam unit taken along the line 5—5 in FIG. 4 showing the ball bearing resting in the recess in the engaging plate;

FIG. 6 is a plan view of the bottom of the buttonhole cam unit with the clutch engaged;

FIG. 7 is a cross-sectional view of portions of the buttonhole cam unit taken along the line 7—7 in FIG. 6 showing the ball bearing engaging one of the notches in the driving plate;

FIG. 8 is a cross-sectional view of the buttonhole cam unit taken substantially along the line 8—8 in FIG. 2; and FIG. 9 is a cross-sectional view taken through the buttonhole cam unit along the line 9—9 of FIG. 8 showing the notched flange of in the driving element of the buttonhole cam unit clutch.

DESCRIPTION OF THE PREFERRED EMBODIMENT

Figure 1:
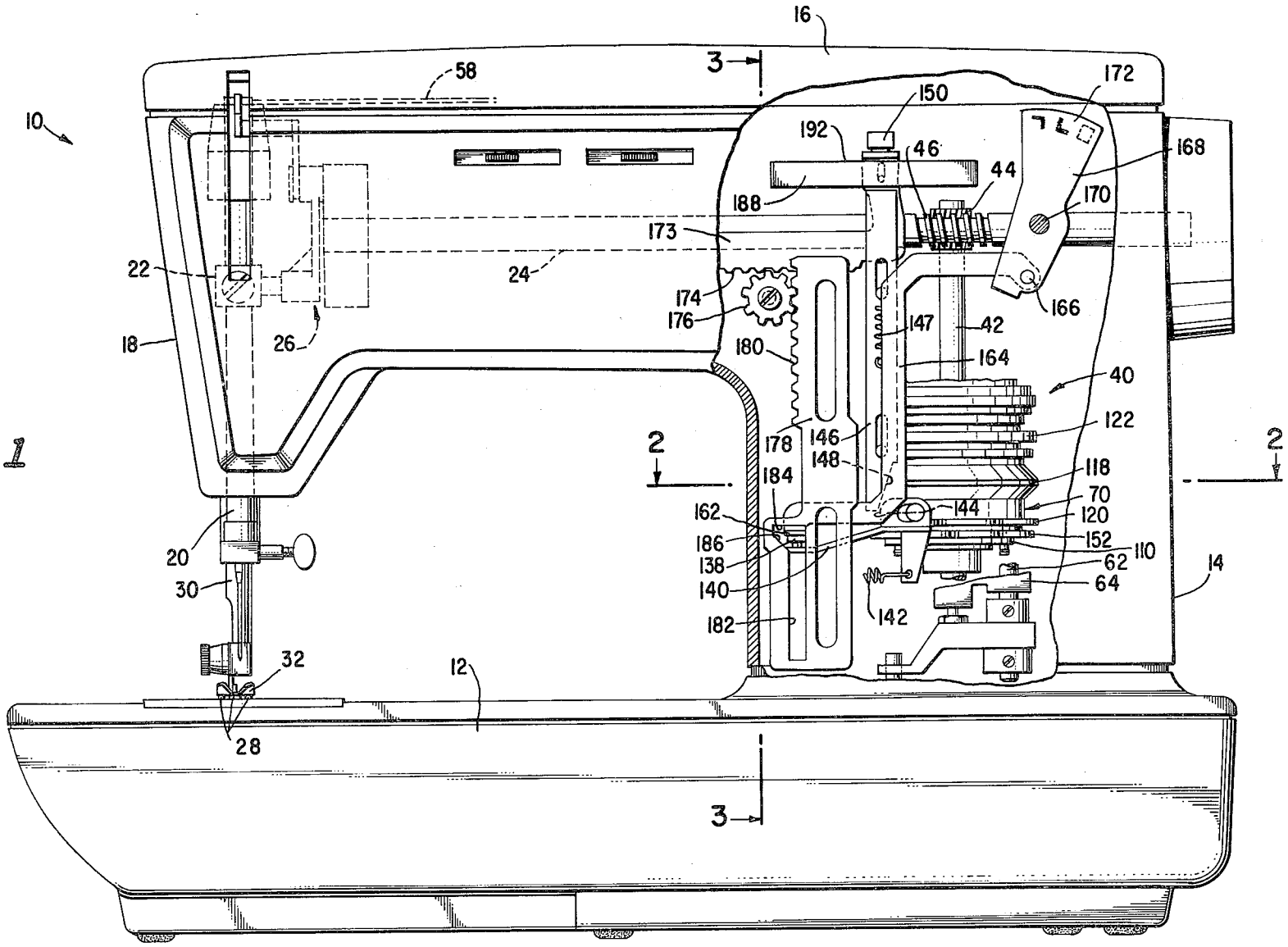
FIG. 1 is a front elevational view, partly in section, of a sewing machine showing the buttonhole cam unit along with the control and indicating linkages therefor.

Referring to FIG. 1, a zig-zag sewing machine is shown bearing the reference number 10. The sewing machine 10 includes a bed 12, a hollow standard 14 rising from the bed 12 and a bracket arm 16 extending from the standard 14 and overhanging the bed 12. The bracket arm 16 terminates in a sewing head 18 which contains a needle bar 20 arranged within a gate 22 for both endwise reciprocatory motion and lateral jogging motion. The bracket arm 16 houses an arm shaft 24, driven by a motor (not shown), which, through suitable linkage 26 imparts the endwise reciprocatory motion to the needle bar 20.

A work feed mechanism as illustrated by feed dog 28 is carried within the bed 12 and may be of any conventional type as, for example, that described in U.S. Pat. No. 3,527,183 of Szostak et al to which reference may be had. A downwardly biased presser bar 30 is carried in the sewing head 18 and, through a presser foot 32 attached to the end of the presser bar 30, urges the material being sewn into engagement with the feed dog 28.

A pattern cam control system is provided with the sewing machine 10 such that certain specific stitch patterns may be sewn automatically, and is substantially similar to the device in U.S. Pat. No. 3,795,210 by Adams et al to which reference may be had for greater detail. The control system includes a frame 38, a cam stack 40 having a cam driving shaft 42 therein, which, in turn, is driven by the arm shaft 24 through a gear 44 and an intermeshing worm 46. Several pattern cam followers, for example, cam followers 48 and 49, are pivotally mounted to a pattern cam follower post 50 and may be slidably positioned axially thereon for tracking the various cams in the cam stack 40. These cam followers, either individually or collectively, impart motion to a hinge plate 52 pivotally mounted to the post 50 and a pattern transfer plate 54 pivotally mounted to the hinge plate 50 by pin 56. The motion of the transfer plate 54 is thence picked up by a needle bar driving arm 58 which motion is then imparted to the needle bar 20 for lateral needle jogging.

A feed cam follower 60, shown in FIG. 2, is pivotally mounted to a support post 62 and engages a feed transfer plate 64. The motion of the transfer plate 64 is then imparted to a feed control system (not shown) which may be as disclosed in my copending patent application, Ser. No. 850,985 (01CU50711), to which reference may be had.

Referring to FIG. 3, for producing buttonholes, a buttonhole cam unit 70 is included within the cam stack 40 having a clutch incorporated therein for selectively taking said cam unit 70 out of driving engagement with the cam shaft 42. The cam unit 70, shown in FIG. 8, comprises a circular driving flange 74 having a plurality of radial notches 76 formed in one surface thereof. The driving flange 74 is formed with a hub 78 having a bore 80 therein through which the cam shaft 42 passes. A set screw 82 in the hub 78 is used to fixedly mount the driving flange 74 to the cam shaft 42.

Underlying the driving flange 74 is a circular ball bearing carrier plate 84 having a cylindrical rim 86 which embraces the driving flange 74. The carrier plate 84 is formed with two diametrically opposed through holes 88 of equal size for slidably carrying two ball bearings 90, and a central bore 91 through which the hub 78 of the driving flange 74 may freely pass. The holes 88 are positioned directly beneath the notches 76 in the driving flange 74 thereby positioning the ball bearings 90 for selective engagement with the notches 76. The ball bearings 90 are of equal size having a diameter greater than the thickness of either the carrier plate 84 or the depth of the notches 76, whereby, when the ball bearings 90 engage two of the notches 76, portions thereof will remain within the holes 88 thus giving a driving relation between the driving flange 74 and the carrier plate 84.

A ball bearing engaging plate 92 underlies the carrier plate 84 and is formed with a central bore 94 through which the hub 78 of the driving flange 74 also passes. The upper surface 96 of the engaging plate 92 is formed with two radial diametrically opposed V-shaped grooves 98. The grooves 98 may be selectively positioned beneath the holes 88 in the carrier plate 84 thereby allowing the ball bearings 90 to rest therein, out of engagement with the notches 76. The engaging plate 92 is formed with an annular protrusion 99 on the underside thereof having two diametrically opposed arcuate slots 100 formed therein through which two pins 102, fixedly attached to the carrier plate 84, may pass. The slots 100 are elongated to allow limited rotation of the engaging plate 92 with respect to the carrier plate 84 such that the grooves 98 may be shifted selectively into and out of alignment with the holes 88. A second two pins 104 are fixed to the annular protrusion 99 on the engaging plate 92 one beyond the end of each of the slots 100. Springs 108 are attached one to each pair of pins, 102 and 104, for biasing the engaging plate 92 such that the grooves 98 therein are out of alignment with the holes 88 in the carrier plate 84. For controlling the relative angular positions of the carrier plate 84 and the engaging plate 92, the annular protrusion 99 on the engaging plate 92 is formed with two diametrically opposed notches 112 and the cylindrical rim 86 of the carrier plate 84 is formed with two diametrically opposed radially extending abutment surfaces 110. The function of these notches 112 and abutments 110 will be explained below. A retaining ring 114 carried in a groove 116 in the hub 78 retains the engaging plate 92 and the carrier plate 84 to the driving flange 74 thereby forming a complete unit.

The outer surface of the cylindrical rim 86 on the carrier plate 84 is formed with a feed cam 118 and a pattern cam 120 which are engaged by cam followers 60 and 48, respectively. The pattern cam 120 in conjunction with a zig-zag cam 122, located elsewhere within the cam stack 40 and tracked by the pattern cam follower 49, combine to control the lateral jogging motion of the needle bar 20 in the formation of the ends and the sides of a buttonhole. In particular, zig-zag cam 122, formed with a plurality of equally spaced lobes each having the same height, controls the size of the zig-zag stitching on each side of a buttonhole, while the pattern cam 120, formed with two dwell portions of different radii joined by a series of equally spaced lobes having a height equal to that dwell portion having the greatest radius, controls the needle position, left or right, and, in concert with the zig-zag cam 122, the bar tack at opposite ends of the buttonhole. The feed cam 118 is formed with two diametrically opposed dwell portions having different radii, representing forward and reverse feed, which two portions are separated by a second two dwell portions of equal radii representing zero feed during which the bar tacks at either end of the buttonhole are formed.

Referring to FIG. 6, the springs 108 urge the pins 104 toward the pins 102 rotating the engaging plate 92 until the pins 102 abut the ends of slots 100. In this condition, referring to FIG. 7, grooves 98 are held out of alignment with holes 88 thereby forcing the ball bearings 90 into the notches 76, locking the buttonhole unit parts together as a rotating unit.

For selectively disengaging the clutch in the buttonhole cam unit 70, a stop pawl 130, pivotally mounted to the pattern cam follower post 50, is formed with a tang 132 in one end thereof for selectively engaging one of the notches 112 in the engaging plate 92, at which time the rotation of the engaging plate 92 will be stopped but the rotation of the driving flange 74 and the carrier plate 84 will continue bringing the holes 88 into alignment with the V-shaped grooves 98 in the engaging plate 92 allowing the ball bearings 90 to rest therein disengaging the carrier plate 84 from the driving flange 74. This condition is illustrated in FIG. 5. To prevent the carrier plate 84 from reverse rotation in response to the spring bias 108, a ratchet pawl 136 is pivotally mounted to the pattern cam follower post 50, and is adapted to engage one of the abutment surfaces 110 to lock the carrier plate 84 in the condition shown in FIG. 4.

The stop pawl 130 has an actuating handle 138 which extends to the opposite side of post 50. This handle 138 is pivotally attached to a lateral slide 140 which is biased by spring 142 in such a manner as will urge the stop pawl 130 into engagement with the edge of the annular protrusion 99 of the engaging plate 92. The lateral slide 140 has an upwardly extending portion 144 which is engaged by a vertical slide 146 at ramp 148. The vertical slide 146 slidably mounted to frame 38, is biased upwardly by a spring 147. The top of the vertical slide 146 is positioned for selective depression by a cam selector button 150. It should be noted that depression of the button 150 will cause the stop pawl 130 to move out of engagement with one of the notches 112 in the engaging plate 92 thereby allowing the engaging plate 92 to rotate with respect to the carrier plate 84 under the influence of the springs 108, the V-shaped grooves 98 therein forcing the ball bearings 90 upward through the carrier plate 84 into engagement with the notches 76 in the driving flange 74. Since the engaging plate 92 rotates a finite amount, the parts will immediately shift into the condition illustrated in FIGS. 6 and 7 whenever the button 150 is depressed, when the button 150 is released, the stop pawl 130 will not be able to re-engage one of the notches 112 in the engaging plate 92 hence the carrier plate 84 and the engaging plate 92 will be driven by the driving flange 74 until the stop pawl 130 is next able to engage the opposite one of the notches 112 and, therefore, a half revolution of the buttonhole unit 70 is effected.

In sewing a buttonhole, it is necessary for the operator to know which portion of the buttonhole the sewing machine is about to commence. Since the buttonhole cam unit 70 of this invention is located at the bottom of the cam stack 40, an indicating mechanism is provided for this purpose. The indicating mechanism includes an indicator cam 152 formed on the periphery of the engaging plate 92. The indicator cam 152 has two dwell portions, 154 and 156, corresponding to the two buttonhole segments. An indicator follower 158 is pivotally mounted near its midpoint to the pattern cam follower post 50 having a first end 160 for engaging the indicator cam 152, and a second end 162 pivotally attached to a sliding bar 164. The sliding bar 164 is pivotally attached at 166 to an indicator flag 168 which is pivotally mounted at 170 to the cam control system frame 38. The indicator flag 168 has indicia 172 thereon corresponding to the different segments of a buttonhole.

The cam selector button 150 is arranged to move both vertically, to engage the vertical slide 146, and laterally for repositioning the various cam followers on the cam stack 40 similarly to the controls of the cam control modular in U.S. Pat. No. 3,795,210. In addition, lateral movement of the button 150 will also move the indicator follower 158 and the stop pawl 138 into and out of engagement with the indicator cam 152 and the engaging plate 92, respectively. For this purpose, the button 150 is slidably mounted to an arm 173 having a horizontal rack 174 formed therein. The rack 174 engages a pinion 176 rotatably mounted to the frame 38. An actuating slide 178 is slidably mounted to the frame 38 and is formed with a vertical rack 180 which also engages the pinion 176. The actuating slide 178 is formed with a slot 182 which embraces the stop pawl actuating handle 138 and the second end 162 of the indicator follower 158. The slot 182 is formed with a wide portion 184 having a ramp 186 at the bottom thereof. When the actuating handle 138 and the second end 162 of the indicator follower 158 lie within the wide portion 184 of the slot 182, the stop pawl 130 and the indicator follower 158 may engage their respective surfaces. Otherwise, the slot forces the stop pawl 130 and the indicator follower 158 out of their respective engagement. The slot 182 is positioned on the actuating slide 178 such that when the selector button 150 is moved laterally to a position where it may engage the vertical slide 146, the wide portion 184 of the slot 182 embraces the stop pawl actuating handle 138 and the second end 162 of the indicator follower 158. The ramp 186 urges the actuating handle 138 and the second end 162 of the indicator follower 158 into the narrow portion of the slot 182 when the actuating slide 178 is moved upwardly by a lateral shifting of the selector button 150. A transfer bar 188, pivotally mounted to the frame 38 at 190, slidably engages the selector button 150 at 192 and, through spring 194, biases the button 150 upwardly.

Numerous alterations of the structure herein disclosed will suggest themselves to those skilled in the art. However, it is to be understood that the present disclosure relates to a preferred embodiment of the invention which is for the purposes of illustration only and not to be construed as a limitation of the invention. All such modifications which do not depart from the spirit of the invention are intended to be included wthin the scope of the appended claims.

Having thus set forth the nature of the invention, what is claimed herein is:

1. A clutch for selectively coupling a buttonholing cam element to a rotating drive shaft comprising:

a clutch driving member secured to said drive shaft and including a driving flange formed with a plurality of radial notches in one surface thereof;

a clutch element of which only a portion may be accommodated in any one of said flange notches;

a clutch element carrier plate rotatable with said buttonholing cam element, said carrier plate being supported adjacent to said clutch driving flange and formed with a through hole shiftable into and out of registry with one of said radial notches in said clutch driving member, said through hole being of a size capable of accommodating only that portion of said clutch element which cannot be accommodated in any one of said notches;

a clutch element engaging plate rotatable about said drive shaft and supported at the opposite side of said carrier plate from said driving flange, and formed with a recess accommodating another portion of said clutch element equivalent to that one portion which may be accommodated in any of said driving flange notches; and means for shifting said clutch engaging plate recess selectively into registry with said carrier plate through hole to accommodate movement of said clutch element to withdraw said one portion out of said driving flange notch as said another portion enters said recess or out of registry with said carrier plate through hole to force said one portion of said clutch element into a notch of said driving flange as said another portion of said clutch element is forced out of said recess.

2. A clutch for selectively coupling a buttonholing cam element to a rotating drive shaft as set forth in claim 1 in which said clutch element is spherically shaped.

3. A clutch for selectively coupling a buttonholing cam element to a rotating drive shaft as set forth in claim 1 in which spring means is arranged to act between said carrier plate and said clutch engaging plate to bias said clutch engaging plate recess out of registry with said carrier plate through hole.

4. A clutch for selectively coupling a buttonholing cam element to a rotating drive shaft as set forth in claim 3 wherein means are provided for selectively overcoming the bias of said spring means comprising operator influenced means for arresting rotation of said clutch engaging plate, whereby said carrier plate will be driven by said driving flange against said bias until said hole therein containing said clutch element aligns with said recess in said engaging plate allowing said clutch element to move out of engagement with said driving plate.

5. In a sewing machine having an endwise reciprocatory needle bar arranged for transverse jogging motion, a variable feed mechanism, and a cam control system for controlling the neutral position and the transverse jogging of said needle bar and the direction and magnitude of feed in accordance with specific pattern cam sewing, a buttonhole cam unit comprising:

a clutch for selectively engaging said buttonhole cam unit, said clutch including a driving flange formed with a plurality of radial notches in one surface thereof, at least one ball bearing for selectively engaging a portion thereof in said notches, a ball bearing carrier plate having at least one hole formed therein for accommodating said ball bearing and having a thickness substantially equivalent to that portion of said ball bearing not engaged in said notches, a ball bearing engaging plate having a recess therein for selectively receiving another portion of said ball bearing equivalent to that portion engagable with said driving flange notches thereby enabling said ball bearing to move through said carrier plate into and out of engagement with said driving plate, means for biasing said engaging plate to such a position as with force said ball bearing through said carrier plate into engagement with said driving plate, and means for axially retaining said plates one to the other;

flange formed around the periphery of said ball bearing carrier plate;

a needle jogging cam and a feed cam formed coaxially on the flange of said ball bearing carrier plate;

means for selectively disengaging said clutch; and means for indicating which portion of said buttonhole cam unit is being used.

6. A buttonhole cam unit as set forth in claim 5 wherein said indicating means comprises an indicating cam formed in the peripheral edge of said engaging plate, said indicating cam having different dwell portions corresponding to the various buttonhole segments, a cam follower arranged to track said indicating cam, a multiposition flag having figures thereon corresponding to the various buttonhole segments, and suitable linkage for transferring the motion of said cam follower, as said cam follower tracks said indicating cam, to said multiposition flag.

* * * * *